US012631399B2

(12) United States Patent
Spreemann et al.

(10) Patent No.: US 12,631,399 B2
(45) Date of Patent: May 19, 2026

(54) WOUND HEAT EXCHANGER AND METHOD

(71) Applicant: Linde GmbH, Pullach (DE)

(72) Inventors: Jürgen Spreemann, Pullach (DE); Hubert Lachenwitzer, Pullach (DE); Luis Matamoros, Pullach (DE); Florian Deichsel, Pullach (DE)

(73) Assignee: Linde GmbH, Pullach (DE)

( * ) Notice: Subject to any disclaimer, the term of this patent is extended or adjusted under 35 U.S.C. 154(b) by 202 days.

(21) Appl. No.: 18/559,501

(22) PCT Filed: May 2, 2022

(86) PCT No.: PCT/EP2022/025195

§ 371 (c)(1),
(2) Date: Nov. 7, 2023

(87) PCT Pub. No.: WO2022/238001

PCT Pub. Date: Nov. 17, 2022

(65) Prior Publication Data

US 2024/0240867 A1 Jul. 18, 2024

(30) Foreign Application Priority Data

May 12, 2021 (EP) ..... 21020252

(51) Int. Cl.

| | |
|---|---|
| ***F28D 7/02*** | (2006.01) |
| ***F28F 9/02*** | (2006.01) |
| *F25J 5/00* | (2006.01) |
| *F28D 21/00* | (2006.01) |
| *F28F 25/04* | (2006.01) |

(52) U.S. Cl.
CPC ..... *F28D 7/024* (2013.01); *F28F 9/0275* (2013.01); *F25J 5/002* (2013.01); *F28D 2021/0033* (2013.01); *F28F 25/04* (2013.01)

(58) Field of Classification Search
CPC ..... F28D 7/024; F28D 3/04; F25J 5/002
See application file for complete search history.

(56) References Cited

U.S. PATENT DOCUMENTS 3,385,352 A 5/1968 Engalitcheff, Jr. et al.
2009/0301130 A1* 12/2009 Schonberger ..... F25J 5/007 62/614

FOREIGN PATENT DOCUMENTS

CN 109357551 A 2/2019
DE 1113680 B * 9/1961
(Continued)

*Primary Examiner* — Eric S Ruppert
(74) *Attorney, Agent, or Firm* — Brion P. Heaney; Millen, White, Zelano & Branigan, P.C.

(57) ABSTRACT

A wound heat exchanger, comprising a shell, a bundle of tubes arranged inside the shell and through which a medium can flow, a first annular channel arranged inside the shell and runs around it for separating a liquid phase of a refrigerant from a gaseous phase of the refrigerant, a second annular channel arranged inside the shell and runs around it and is intended for evenly distributing the liquid phase over the bundle of tubes in order to exchange the heat between the refrigerant and the medium, and a connecting channel which establishes a fluid connection between the first annular channel and the second annular channel in order to conduct the liquid phase out of the first annular channel into the second annular channel, wherein the first annular channel and the second annular channel are spaced apart.

20 Claims, 3 Drawing Sheets

(56) References Cited

FOREIGN PATENT DOCUMENTS

| | | | |
|---|---|---|---|
| DE | 102011017030 | A1 | 10/2012 |
| DE | 102011103583 | A1 | 12/2012 |
| EP | 3447425 | A1 | 2/2019 |
| WO | 2006021315 | A1 | 3/2006 |

* cited by examiner

WOUND HEAT EXCHANGER AND METHOD

The invention relates to a wound heat exchanger and to a method for the exchange of heat between a refrigerant and a medium with the aid of such a wound heat exchanger.

Liquefied natural gas (LNG) is natural gas that has been liquefied and processed by means of cooling to between −161° C. and −164° C. Liquefied natural gas has only a fraction of the volume of gaseous natural gas. Liquefied natural gas therefore has great advantages, particularly for transport and storage purposes. The liquefied natural gas can be transported as a liquid in suitable transport containers by road, rail or water.

In order to liquefy the natural gas, so-called coil-wound heat exchangers (CWHEs) or wound heat exchangers can be used according to internal findings. Such a wound heat exchanger comprises a shell and a bundle of tubes accommodated in the shell through which the natural gas to be liquefied is conducted. The bundle of tubes is sprinkled with a liquid phase of a two-phase refrigerant, for example using a so-called annular channel distributor.

Such an annular channel distributor comprises an annular channel running around the inside of the shell and distributors extending radially out of the annular channel, which distribute the liquid phase evenly over the bundle of tubes. Between the distributors, tubes, so-called heads, of the bundle of tubes are guided upwards past the annular channel distributor to a tube sheet. The higher the annular channel, the further the tube sheet is spaced apart from the bundle of tubes and the longer the tubes leading to the tube sheet must be. This can complicate the manufacture of the wound heat exchanger. This must be improved.

Against this background, the object of the present invention is to provide an improved wound heat exchanger.

Accordingly, a wound heat exchanger for the exchange of heat between a refrigerant and a medium is proposed. The wound heat exchanger comprises a shell, a bundle of tubes which is arranged inside the shell and through which the medium can flow, a first annular channel which is arranged inside the shell and runs around it and is intended for separating a liquid phase of the refrigerant from a gaseous phase of the refrigerant, a second annular channel which is arranged inside the shell and runs around it and is intended for evenly distributing the liquid phase over the bundle of tubes in order to exchange the heat between the refrigerant and the medium, and a connecting channel which establishes a fluid connection between the first annular channel and the second annular channel in order to conduct the liquid phase out of the first annular channel into the second annular channel, wherein the first annular channel and the second annular channel are spaced apart from one another when viewed along an axis of symmetry of the shell.

Because a first annular channel and a second annular channel separated from the first annular channel are provided, it is possible to design the first annular channel and the second annular channel with different widths. On the one hand, this facilitates manufacture and, on the other hand, can lead to a reduction in the accumulation of the liquid phase in the annular channels. Furthermore, a pre-separation of the liquid phase and the gaseous phase of the refrigerant can be achieved with the aid of the first annular channel.

The wound heat exchanger is in particular a so-called coil-wound heat exchanger (CWHE). The wound heat exchanger is preferably suitable for liquefying natural gas. This means that the medium can be natural gas. However, the wound heat exchanger can also be used to liquefy any media other than natural gas. The bundle of tubes is in particular wound in multiple layers onto a core tube arranged centrally in the shell. The shell preferably comprises a hollow cylindrical base portion, which can be constructed so as to be rotationally symmetrical with respect to the axis of symmetry, a cover portion closing the base portion at the top and a bottom portion closing the base portion at the bottom. The axis of symmetry can also be referred to as the central axis. The shell is in particular fluid-tight.

The bundle of tubes comprises a tube side and a shell side. In the present case, the "tube side" is understood to mean an interior space enclosed by tubes of the bundle of tubes, through which the medium to be liquefied is conducted. The medium is thus fed into the tubes of the bundle of tubes. The term "feeding" the medium into the bundle of tubes means, in particular, that the medium is introduced into the tubes of the bundle of tubes. On the tube side, a plurality of different fractions or tube flows can flow through the bundle of tubes. One of the fractions can be the medium. Another of the fractions may be a portion of the refrigerant. Further fractions can comprise, for example, other refrigerants, process media or the like.

This means that the refrigerant can also be fed into the bundle of tubes and conducted through the bundle of tubes on the tube side. However, no direct contact and thus also no mixing of the fractions in the bundle of tubes is possible. The bundle of tubes thus has tubes through which only the medium flows. Only the refrigerant flows through other tubes. Furthermore, additional tubes can also be provided through which additional fractions flow. The aforementioned different tubes can form different layers of the bundle of tubes.

In the present case, "shell side" is understood to mean a region outside the tubes of the bundle of tubes. On the shell side, the refrigerant flows through the bundle of tubes. A large number of gaps or passages lead through the bundle of tubes, through which the refrigerant is conducted in order to extract heat from the bundle of tubes, in particular from the medium. When heat is exchanged between the refrigerant and the medium, heat is preferably removed from the medium and absorbed by the refrigerant. The refrigerant can thereby at least partially evaporate. The refrigerant can also evaporate completely. After flowing around or through the bundle of tubes on the shell side, the completely or partially evaporated refrigerant can be drawn off from the shell.

The refrigerant can be ethane, for example. However, any other desired refrigerant can also be used. A refrigerant is suitable for transporting enthalpy from a product to be cooled, in this case the medium, to an environment. The difference from a coolant is that a refrigerant can carry out this heat transport in a cooling circuit along a temperature gradient, so that when energy is applied, the ambient temperature may even be higher than the temperature of the medium to be cooled, while a coolant is only able to transport the enthalpy against the temperature gradient to a point at a lower temperature in a cooling circuit. As a result of the removal of heat from the medium, it is liquefied. In the event that the medium is natural gas, the liquefied medium or natural gas may be referred to as liquefied natural gas (LNG).

The first annular channel can also be referred to as an upper annular channel, since it is arranged above the second annular channel with respect to a direction of gravity. Accordingly, the second annular channel can be referred to as the lower annular channel. The fact that the first annular channel "runs" around the shell means, in the present case, that the first annular channel preferably runs completely around the axis of symmetry and thus forms an annular shape. The first annular channel can thereby be continuous. Alternatively, it is also possible for the first annular channel to be subdivided into a plurality of separate ring segments. The same applies to the second annular channel. The first annular channel and the second annular channel are two separate components which are arranged at a certain distance from one another when viewed along the axis of symmetry.

The connecting channel can be a tube, a shaft, a hose or the like. With the aid of the connecting channel, the liquid medium is conducted from the first annular channel into the second annular channel. The connecting channel is a downpipe or can be referred to as a downpipe. Any number of connecting channels can be provided. The connecting channel can have a circular or any other cross section.

The second annular channel is suitable for evenly distributing the liquid phase of the refrigerant over the bundle of tubes. For this purpose, the second annular channel can comprise distributors that will be explained below. These distributors are, in particular, part of the second annular channel. Furthermore, the second annular channel can also itself have openings, bores or the like, which allow the bundle of tubes to be evenly sprinkled with the liquid phase of the refrigerant. The second annular channel can also be referred to as an annular channel distributor.

The first annular channel is suitable for separating the liquid phase of the refrigerant from the gaseous phase of the refrigerant. The separation takes place in that the liquid phase is drawn off downwards in the direction of the second annular channel with the aid of the connecting channel and in that the gaseous phase of the refrigerant emerges upwards from the first annular channel. This means that the refrigerant is biphasic and can have the liquid phase and the gaseous phase. The liquid phase can transition into the gaseous phase, and vice versa. In particular, the liquid phase of the refrigerant at least partially transitions from the liquid phase to the gaseous phase as it flows through or around the bundle of tubes. The evaporating refrigerant thereby absorbs heat from the medium.

According to one embodiment, the second annular channel comprises a plurality of distributors for evenly distributing the liquid phase over the bundle of tubes, wherein the distributors protrude radially towards the axis of symmetry further into the shell than the second annular channel.

The number of distributors is basically arbitrary. For example, three distributors or six distributors are provided. The distributors are placed so as to be evenly spaced apart from one another around the axis of symmetry. The distributors protrude radially from the second annular channel into the shell and thus partially cover the bundle of tubes from above. The distributors are, in particular, part of the second annular channel and are in fluid connection therewith. The fact that the distributors are "in fluid connection" with the second annular channel in the present case means, in particular, that the liquid phase of the refrigerant can flow from the second annular channel into the distributors. The distributors preferably each have a plurality of breakthroughs, openings, bores or the like arranged on the underside, which allow the bundle of tubes to be evenly sprinkled with the liquid phase of the refrigerant.

According to a further embodiment, the distributors are arranged so as to be evenly distributed around the axis of symmetry, wherein an intermediate space is provided between two adjacent distributors in each case.

The number of intermediate spaces preferably corresponds to the number of distributors. In particular, the distributors and the intermediate spaces are arranged alternately, so that an intermediate space is placed between two distributors and a distributor is placed between two intermediate spaces.

According to a further embodiment, the wound heat exchanger further comprises a plurality of connecting channels, wherein a connecting channel is associated with each distributor.

This means, in particular, that the number of distributors and the number of connecting channels are the same. For example, three or six connecting channels are provided.

According to a further embodiment, the connecting channel runs parallel to the axis of symmetry.

In particular, the connecting channel runs along the direction of gravity. By arranging the connecting channel or the connecting channels parallel to the axis of symmetry, the shortest possible connection between the first annular channel and the second annular channel can be achieved. In particular, the connecting channels open out of a bottom of the first annular channel.

According to a further embodiment, the first annular channel and the second annular channel protrude radially towards the axis of symmetry to different extents into the shell.

In particular, the first annular channel and the second annular channel protrude radially to different extents into an interior space enclosed by the shell. The first annular channel has a first inside diameter. The second annular channel has a second inside diameter. The inside diameters can be of different sizes, so that the first annular channel and the second annular channel protrude to different extents into the shell. Alternatively, the first inside diameter of the first annular channel and the second inside diameter of the second annular channel can also be of the same size.

According to a further embodiment, the second annular channel protrudes radially further into the shell on the axis of symmetry than the first annular channel.

This means, in particular, that the second annular channel is wider than the first annular channel. This facilitates the manufacture of the wound heat exchanger.

According to a further embodiment, the first annular channel is arranged above the second annular channel when viewed along a direction of gravity.

As mentioned above, the first annular channel can therefore also be referred to as the upper annular channel and the second annular channel can be referred to as the lower annular channel. When viewed along the direction of gravity, the second annular channel is placed below the first annular channel.

According to a further embodiment, the wound heat exchanger further comprises a tube sheet which is in fluid connection with tubes of the bundle of tubes, wherein the tube sheet is arranged between the first annular channel and the second annular channel when viewed along the axis of symmetry.

In particular, the tube sheet is placed below the first annular channel and above the second annular channel when viewed along the direction of gravity. A plurality of tube sheets can be provided. Preferably, the number of tube sheets corresponds to the number of distributors. It is also possible to provide twice as many tube sheets as distributors. Because the tube sheet is arranged between the first annular channel and the second annular channel, it is possible to shorten the tubes drawn upwards from the bundle of tubes in comparison with a wound heat exchanger having only one annular channel. This makes it easier to manufacture the wound heat exchanger. The upwardly drawn tubes can also be referred to as "heads". A reduction of the "head length" can thus be achieved.

According to a further embodiment, the first annular channel and/or the second annular channel each run completely around the axis of symmetry.

This means that the first annular channel and/or the second annular channel each have a circumferential angle of 360°. As mentioned above, however, it is also fundamentally possible for the first annular channel and/or the second annular channel to be subdivided into a plurality of separate annular channel segments.

According to a further embodiment, the first annular channel and/or the second annular channel are each open in the direction of a cover portion of the shell.

In particular, the first annular channel and/or the second annular channel are open at the top. This makes it possible for the gaseous phase of the refrigerant to emerge upwards from the corresponding annular channel.

Furthermore, a method for the exchange of heat between a refrigerant and a medium with the aid of such a wound heat exchanger is proposed. The heat exchanger comprises a shell, a bundle of tubes which is arranged inside the shell, a first annular channel which is arranged inside the shell and runs around it, a second annular channel which is arranged inside the shell and runs around it, and a connecting channel which establishes a fluid connection between the first annular channel and the second annular channel, wherein the first annular channel and the second annular channel are spaced apart from one another when viewed along an axis of symmetry of the shell. The method comprises the following steps: a) the medium flowing through the bundle of tubes, b) separating a liquid phase of the refrigerant from a gaseous phase of the refrigerant with the aid of the first annular channel, c) conducting the liquid phase into the second annular channel with the aid of the connecting channel, and d) evenly distributing the liquid phase over the bundle of tubes with the aid of the second annular channel in order to exchange the heat between the refrigerant and the medium.

Steps a) to d) can be carried out simultaneously. In particular, during step d), heat is removed from the medium with the aid of the refrigerant. The refrigerant can thereby at least partially evaporate and transition into the gaseous phase. The medium can thereby be liquefied or at least cooled. The medium flows through the bundle of tubes, in particular on the tube side. The liquid phase is distributed, in particular, onto the shell side of the bundle of tubes.

According to one embodiment, in step d), the liquid phase is evenly distributed over the bundle of tubes with the aid of a plurality of distributors of the second annular channel.

The number of distributors is basically arbitrary. By providing a plurality of distributors, a particularly even distribution of the liquid phase can be achieved. The distributors are preferably part of the second annular channel.

According to a further embodiment, in step d), the liquid phase is accumulated in the second annular channel such that the connecting channel opens into the second annular channel below a liquid level of the liquid phase in the second annular channel.

In particular, a lower edge of the connecting channel is arranged below the liquid level. The connecting channel is thus immersed or submerged in the liquid phase.

According to a further embodiment, in step b), the liquid phase, when viewed along a direction of gravity, is drawn off downwards from the first annular channel with the aid of the connecting channel, wherein the gaseous phase emerges upwards from the first annular channel when viewed along the direction of gravity.

The gaseous phase can be drawn off from the shell at the cover portion. The liquid phase of the refrigerant that emerges downwards from the bundle of tubes and has not evaporated can also be drawn off from the shell.

The embodiments and features described for the proposed wound heat exchanger apply correspondingly for the proposed method and vice versa.

In the present case, "a(n)" is not necessarily to be understood as limiting to exactly one element. It is rather the case that several elements, such as two, three, or more, may also be provided. Any other numerical word used herein is also not to be understood as meaning an exact limitation to exactly the corresponding number of elements. Rather, numerical differences upwards or downwards are possible.

Further possible implementations of the wound heat exchanger and/or of the method also include not explicitly mentioned combinations of features or embodiments described above or below with respect to the exemplary embodiments. A person skilled in the art will also add individual aspects as improvements or additions to the respective basic form of the wound heat exchanger and/or of the method.

Further advantageous embodiments of the wound heat exchanger and/or of the method are the subject matter of the dependent claims and of the exemplary embodiments of the wound heat exchanger and/or of the method described below. The wound heat exchanger and/or the method are explained below in more detail with reference to the accompanying figures based on preferred embodiments.

In the figures, the same or functionally equivalent elements have been provided with the same reference signs unless otherwise indicated.

Figure 1:
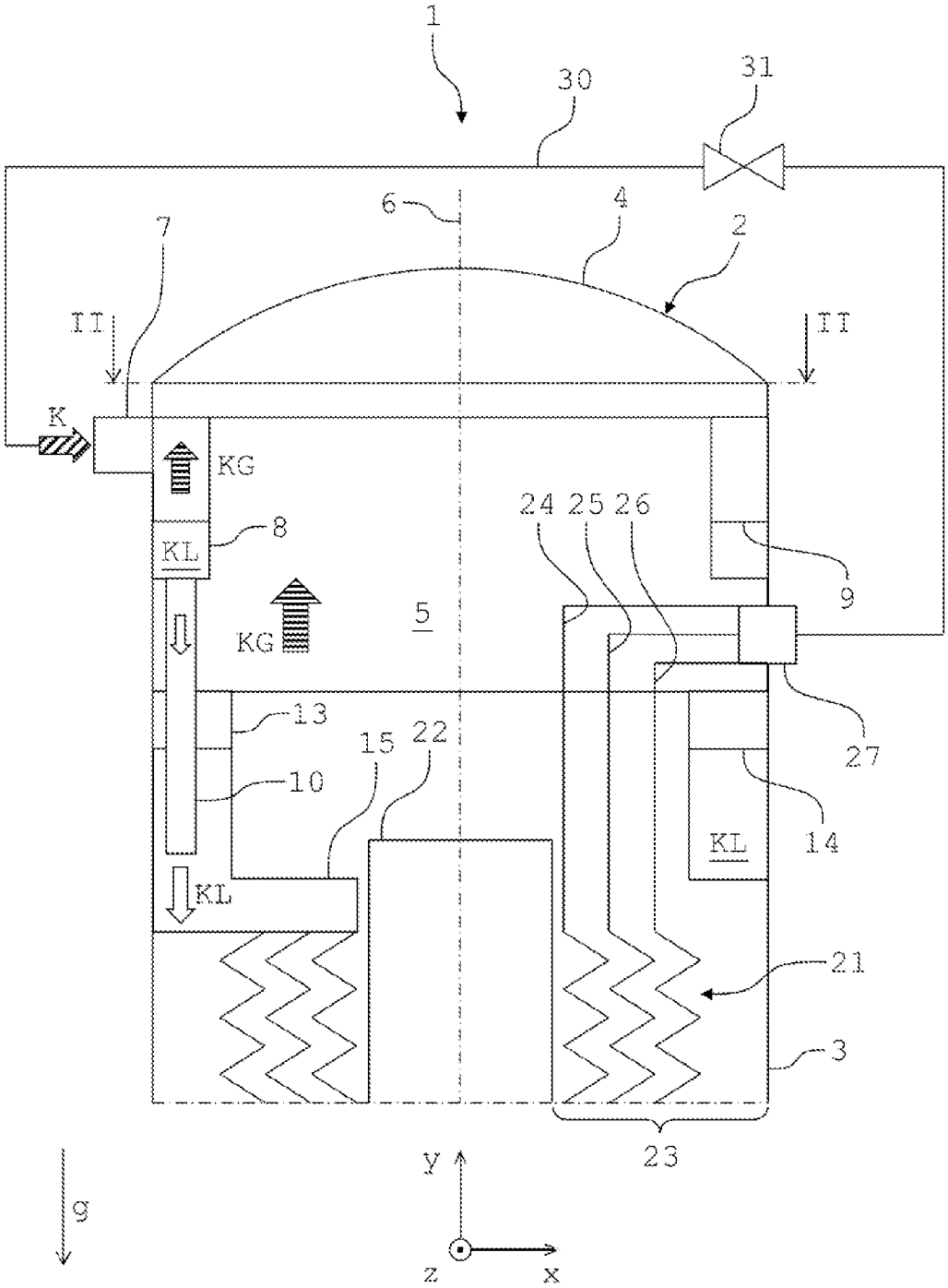
FIG. 1 shows a schematic sectional view of an embodiment of a wound heat exchanger.
Figure 2:
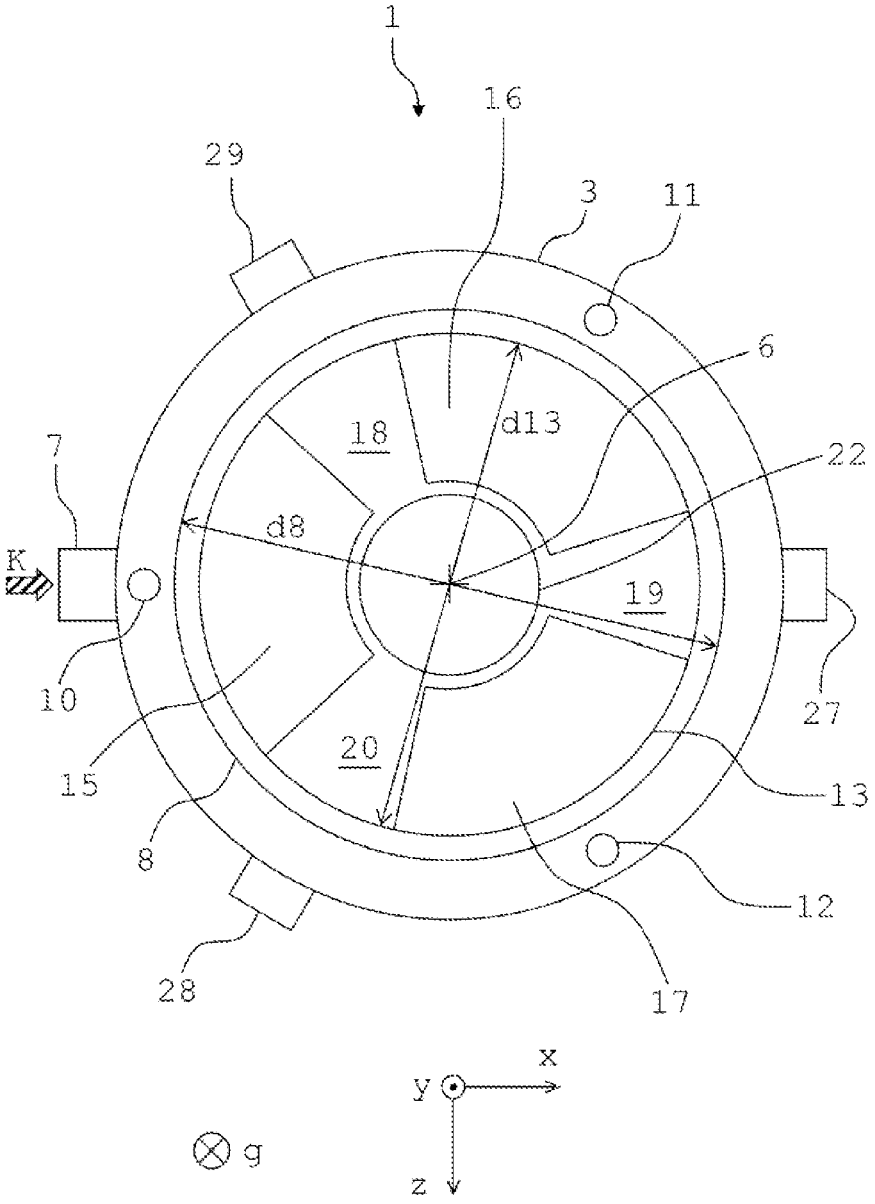
FIG. 2 shows a schematic sectional view of the wound heat exchanger according to the intersecting line II-II of FIG. 1.

FIG. 1 shows a schematic sectional view of an embodiment of a coil-wound heat exchanger (CWHE) 1. FIG. 2 shows a schematic sectional view of the wound heat exchanger 1. In the following, reference is made simultaneously to FIGS. 1 and 2.

Such a wound heat exchanger 1 can be used to liquefy natural gas (LNG). However, other gases can also be liquefied. The wound heat exchanger 1 is referred to below simply as a heat exchanger.

The heat exchanger 1 comprises a shell 2. The shell 2 is constructed from a cylindrical base portion 3, a dome-shaped cover portion 4 and a dome-shaped bottom portion (not shown). With respect to a direction of gravity g, the cover portion 4 is placed above the bottom portion. For example, the base portion 3, the cover portion 4 and the bottom portion are soldered, welded, screwed or riveted to one another.

The shell 2 is fluid-tight. The shell 2 encloses an interior space 5. The shell 2 can be made of an aluminum alloy or a steel alloy. The shell 2 is substantially rotationally symmetrical with respect to a central axis or an axis of symmetry 6. Here, "substantially" means that the shell 2 does not necessarily have to have a circular cross section. The shell 2 can also be slightly oval or elliptical in cross section. The shell 2 is placed upright or vertically. This means that the axis of symmetry 6 runs parallel to the direction of gravity g.

The heat exchanger 1 is associated with a coordinate system having a width or x direction x, a vertical or y direction y and a depth or z direction z. The directions x, y, z are oriented perpendicularly to one another. The z direction z is oriented parallel to the direction of gravity g and parallel to the axis of symmetry 6.

An inlet connection piece 7, which is oriented perpendicularly to the axis of symmetry 6, is provided on the base portion 3. A refrigerant K, for example ethane, can be supplied to the heat exchanger 1 via the inlet connection piece 7. The refrigerant K can be biphasic, so that it has a liquid phase KL and a gaseous phase KG. A plurality of inlet connection pieces 7 can be provided.

The refrigerant K is shown in FIGS. 1 and 2 with the aid of block arrows. Block arrows with slanted hatching represent a two-phase state of the refrigerant K. Horizontally hatched block arrows represent the gaseous phase KG of the refrigerant K. Unhatched block arrows represent the liquid phase KL of the refrigerant K.

The refrigerant K can be fed into an upper or first annular channel 8 via the inlet connection piece 7. The first annular channel 8 can be rectangular in cross section. The first annular channel 8 is arranged inside the shell 2. The first annular channel 8 runs completely around the axis of symmetry 6, so that the first annular channel 8 has a closed annular shape. In principle, however, the first annular channel 8 can also be subdivided into a plurality of ring segments. The first annular channel 8 has an inside diameter d8.

The first annular channel 8 is open upwards, that is to say in the direction of the cover portion 4, so that the gaseous phase KG can emerge from the first annular channel 8 upwards against the direction of gravity g. The gaseous phase KG can be drawn off from the shell 2, for example, with the aid of a withdrawal connection piece provided on the cover portion 4. Alternatively, the gaseous phase KG can be drawn off downwards together with the liquid phase KL. The first annular channel 8 projects radially, that is, in the direction of the axis of symmetry 6, into the shell 2, in particular into the interior space 5.

A liquid level 9 of the liquid phase KL becomes established in the first annular channel 8. The first annular channel 8 serves to separate the gaseous phase KG from the liquid phase KL. The separation takes place in that the gaseous phase KG, as mentioned above, can escape upwards from the first annular channel 8 and in that the liquid phase KL is drawn off downwards, that is in the direction of gravity g, from the first annular channel 8 with the aid of a connecting channel 10.

The connecting channel 10 runs parallel to the direction of gravity g or parallel to the axis of symmetry 6. The connecting channel 10 can be a shaft, a tube or the like. A plurality of connecting channels 10 to 12 are preferably provided. The number of connecting channels 10 to 12 is basically arbitrary. For example, three or six connecting channels 10 to 12 are provided. The connecting channels 10 to 12 are arranged so as to be evenly distributed around the axis of symmetry 6. However, only one connecting channel 10 is discussed below.

The connecting channel 10 conducts the liquid phase KL from the first annular channel 8 into a lower or second annular channel 13. When viewed along the axis of symmetry 6, the second annular channel 13 is spaced apart from the first annular channel 8. When viewed along the direction of gravity g, the first annular channel 8 is placed above the second annular channel 13 or the second annular channel 13 is placed below the first annular channel 8.

Like the first annular channel 8, the second annular channel 13 can be rectangular in cross section. The second annular channel 13 is arranged inside the shell 2. The second annular channel 13 runs completely around the axis of symmetry 6, so that the second annular channel 13 has a closed annular shape. In principle, however, the second annular channel 13 can also be subdivided into a plurality of ring segments. The second annular channel 13 has an inside diameter d13. The inside diameter d13 can be smaller than the inside diameter d8. Alternatively, the inside diameters d8, d13 can also be of the same size. Furthermore, the inside diameter d8 can also be smaller than the inside diameter d13.

The second annular channel 13 is open upwards, that is to say in the direction of the cover portion 4, so that the gaseous phase KG can emerge from the second annular channel 13 upwards against the direction of gravity g. The second annular channel 13 projects radially, that is, in the direction of the axis of symmetry 6, into the shell 2, in particular into the interior space 5. The second annular channel 13 preferably projects further into the shell 2 than the first annular channel 8.

A liquid level 14 of the liquid phase KL is established in the second annular channel 13. The connecting channel 10 is immersed in the liquid phase, so that a lower edge of the connecting channel 10 is placed below the liquid level 14 when viewed along the direction of gravity g. The second annular channel 13 serves to evenly distribute the liquid phase KL over a plurality of distributors 15 to 17. The distributors 15 to 17 are part of the second annular channel 13.

The number of distributors 15 to 17 is arbitrary. For example, three or six distributors 15 to 17 are provided. The number of distributors 15 to 17 preferably corresponds to the number of connecting channels 10 to 12. A connecting channel 10 to 12 can be associated with each distributor 15 to 17. The distributors 15 to 17 are arranged so as to be evenly distributed around the axis of symmetry 6 or around a circumference of the shell 2.

The distributors 15 to 17 can be designed as ring segments. However, this is not mandatory. A "ring segment" is to be understood in the present case as a portion of a ring. The distributors 15 to 17 are arranged alternately with intermediate spaces 18 to 20. This means that an intermediate space 18 to 20 is arranged between two adjacent distributors 15 to 17 in each case and a distributor 15 to 17 is arranged between two intermediate spaces 18 to 20 in each case. Only one distributor 15 is discussed below.

The distributor 15 points radially in the direction of the axis of symmetry 6 further into the shell 2, in particular into the interior space 5, than the second annular channel 13. The distributor 15 is in fluid connection with the second annular channel 13. In the present case, "fluid connection" means, in particular, that the liquid phase KL can flow from the second annular channel 13 into the distributor 15. For this purpose, for example, a breakthrough, an opening or the like can be provided in a bottom of the second annular channel 13.

The distributor 15 is closed upwards, i.e. in the direction of the cover portion 4. The liquid phase KL can emerge from the distributor 15 downwards, i.e. away from the cover portion 4. For this purpose, the distributor 15 has a plurality of outlet openings, breakthroughs, bores or the like on the underside, with the aid of which the liquid phase KL can be evenly distributed.

The heat exchanger 1 further comprises a bundle of tubes 21 arranged inside the shell 2, which bundle of tubes is sprinkled with the liquid phase KL with the aid of the distributors 15 to 17. The liquid phase KL is thereby evaporated, in particular, with the aid of a falling film. The bundle of tubes 21 is wound onto a core tube 22, which is placed centrally in the shell 2. The bundle of tubes 21 comprises a plurality of tubes which are wound in multiple layers onto the core tube 22. The bundle of tubes 21 comprises slots or gaps, so that the liquid phase KL can flow through the bundle of tubes 21 on the shell side. In the present case, "shell side" is understood to mean a region outside the tubes of the bundle of tubes 21. The bundle of tubes 21 completely fills an annular gap 23 provided between the core tube 22 and the shell 2.

A plurality of different fractions or tube flows can be guided through the bundle of tubes 21 on the tube side. One of the fractions can be a medium to be liquefied, for example natural gas. Another of the fractions can be the liquid phase KL of the refrigerant K. Further fractions can comprise, for example, other refrigerants, process media or the like. This means that the refrigerant K can also be fed into the bundle of tubes 21 and conducted through the bundle of tubes 21 on the tube side. However, no direct contact and thus also no mixing of the fractions in the bundle of tubes 21 is possible.

The bundle of tubes 21 thus has tubes through which only the medium flows. Only the refrigerant K flows through other tubes. Furthermore, additional tubes can also be provided through which additional fractions flow. The aforementioned different tubes can form different layers of the bundle of tubes 21. In the present case, the "tube side" is understood to mean an interior space enclosed by the tubes of the bundle of tubes 21 through which the medium to be liquefied, the refrigerant K and/or other fractions are conducted.

Individual tubes 24 to 26 are drawn from the bundle of tubes 21 upwards through the intermediate spaces 18 to 20 in the direction of the cover portion 4. The tubes 24 to 26 run parallel to the axis of symmetry 6. The tubes 24, 26 can also be referred to as "heads". The tubes 24 to 26 are supplied to a tube sheet 27. A plurality of tube sheets 27 to 29 are preferably provided. The number of tubes 27 to 29 can correspond to the number of distributors 15 to 17. However, this is not mandatory. For example, it is also possible to provide twice as many tube sheets 27 to 29 as distributors 15 to 17.

When viewed along the axis of symmetry 6, the tube sheets 27 to 29 can be placed at different heights. This means that the tube sheets 27 to 29 can be arranged so as to be offset from one another along the axis of symmetry 6. However, the tube sheets 27 to 29 can also all be arranged at the same height. The tube sheets 27 to 29 can be associated with different tube flows or fractions of the bundle of tubes 21.

The tube sheets 27 to 29 are welded or soldered into the shell 2. The tube sheets 27 to 29 can also be connected to the shell 2 by means of connection pieces (not shown). The tube sheets 27 to 29 can be arranged so as to be evenly distributed around the axis of symmetry 6. However, this is not mandatory. The tube sheets 27 to 29 can also be arranged so as to be unevenly distributed around the axis of symmetry 6. At least one tube sheet 27 to 29 can be associated with each intermediate space 18 to 20. However, this is not mandatory. Only one tube sheet 27 is discussed below.

The tube sheet 27 is in fluid connection with the inlet connection piece 7 via a supply line 30 and an expansion valve 31. In particular, tubes of the bundle of tubes 21 through which the refrigerant K is guided on the tube side are in fluid connection with the inlet connection piece 7 via the tube sheet 27 and the supply line 30. The expansion valve 31 is a so-called Joule-Thomson valve. The coolant K flowing through the bundle of tubes 21 is returned to the inlet connection piece 7 via the supply line 30. It is under higher pressure compared to the interior space 5 of the shell 2. The refrigerant K is expanded in the expansion valve 31 and supplied to the inlet connection piece 7 as a two-phase flow. During the expansion, expansion cooling takes place, which cools the refrigerant K. The bundle of tubes 21 is then cooled again with this "colder" refrigerant K.

The tubes 24 to 26 are in fluid connection with the tube sheet 27. The tube sheet 27 is placed between the first annular channel 8 and the second annular channel 13 when viewed along the axis of symmetry 6. In particular, the tube sheet 27 is placed below the first annular channel 8 and above the second annular channel 13.

In comparison with a heat exchanger having only one annular channel, it is thereby possible to shorten the length of the tubes 24 to 26. This makes it easier to manufacture the heat exchanger 1. Furthermore, by providing two separate annular channels 8, 13, it is possible to design the annular channels 8, 13 with different widths. On the one hand, this simplifies manufacture and, on the other hand, can lead to a reduction in the accumulation of the liquid phase KL in the annular channels 8, 13.

The functionality of the heat exchanger 1 is explained below. The medium to be liquefied flows through the bundle of tubes 21 on the tube side. The two-phase refrigerant K is supplied to the first annular channel 8 via the inlet connection piece 7. In the first annular channel 8, the liquid phase KL is separated from the gaseous phase KG in that the liquid phase KL is drawn off downwards into the second annular channel 13 with the aid of the connecting channels 10 to 12 and the gaseous phase KG escapes upwards. The gaseous phase KG can be drawn off upwards or downwards. For example, the gaseous phase KG can be drawn off downwards together with the liquid phase KL via the bundle of tubes 21.

The second annular channel 13 distributes the liquid phase KL evenly over the distributors 15 to 17, which in turn sprinkle the bundle of tubes 21 with the liquid phase KL. The liquid phase KL flows through the bundle of tubes 21 on the shell side, wherein the liquid phase KL at least partially evaporates. This removes heat from the medium. The medium liquefies. The evaporated liquid phase KL rises upwards as a gaseous phase KG and can be drawn off upwards. Alternatively, the gaseous phase KG can also be drawn off downwards through the bundle of tubes 21. The liquid phase KL that does not evaporate flows out of the bundle of tubes 21 on the underside and can be drawn off downwards.

Figure 3:
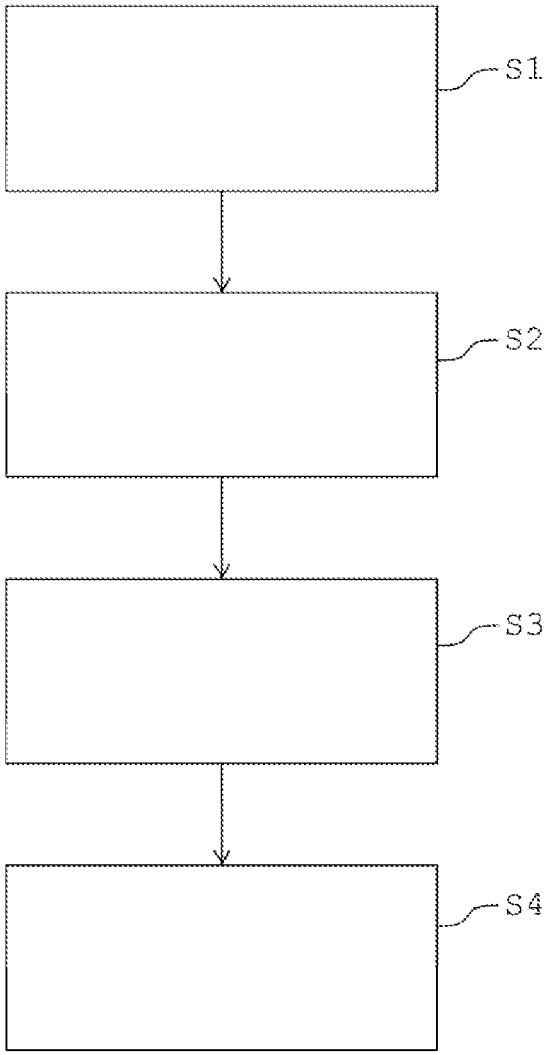
FIG. 3 shows a schematic block diagram of an embodiment of a method for the exchange of heat between a refrigerant and a medium with the aid of the wound heat exchanger according to FIG. 1.

FIG. 3 shows a schematic block diagram of an embodiment of a method for the exchange of heat between the refrigerant K and the medium with the aid of the wound heat exchanger 1. In a step S1, the medium flows through the bundle of tubes 21. In a step S2, the liquid phase KL of the refrigerant K is separated from the gaseous phase KG by means of the first annular channel 8.

In a step S3, the liquid phase KL is conducted into the second annular channel 13 with the aid of the connecting channels 10 to 12. In a step S4, the liquid phase KL is evenly distributed over the bundle of tubes 21 with the aid of the distributors 15 to 17 in order to exchange the heat between the refrigerant K and the medium. Steps S1 to S4 can be carried out simultaneously.

Although the present invention has been described with reference to exemplary embodiments, it can be modified in many ways within the scope of the claims.

REFERENCE SIGNS USED

1 Heat exchanger
2 Shell
3 Base portion
4 Cover portion
5 Interior space
6 Axis of symmetry
7 Inlet connection piece
8 Annular channel
9 Liquid level
10 Connecting channel
11 Connecting channel
12 Connecting channel
13 Annular channel
14 Liquid level
15 Distributor
16 Distributor
17 Distributor
18 Intermediate space
19 Intermediate space
20 Intermediate space
21 Bundle of tubes
22 Core tube
23 Annular gap
24 Tube
25 Tube
26 Tube
27 Tube sheet
28 Tube sheet
29 Tube sheet
30 Supply line
31 Expansion valve
d8 Inside diameter
d13 Inside diameter
g Direction of gravity
K Refrigerant
KG Gaseous phase
KL Liquid phase
S1 Step
S2 Step
S3 Step
S4 Step
x x direction
y y direction
z z direction

The invention claimed is:

1. A wound heat exchanger for the exchange of heat between a refrigerant and a medium, comprising:

a shell having an inner surface, a bundle of tubes which is arranged inside the shell and through which the medium can flow, a first annular channel which is arranged inside the shell and runs around the inner surface of the shell and is intended for separating a liquid phase of the refrigerant from a gaseous phase of the refrigerant, a second annular channel which is arranged inside the shell and runs around the inner surface of the shell and is intended for evenly distributing the liquid phase over the bundle of tubes in order to exchange the heat between the refrigerant and the medium, and a connecting channel which establishes a fluid connection between the first annular channel and the second annular channel in order to conduct the liquid phase out of the first annular channel into the second annular channel, wherein the first annular channel and the second annular channel are spaced apart from one another along an axis of symmetry of the shell.

2. The wound heat exchanger according to claim 1, wherein the second annular channel comprises a plurality of distributors for evenly distributing the liquid phase over the bundle of tubes, and wherein the distributors protrude radially towards the axis of symmetry of the shell further into the shell than the second annular channel.

3. The wound heat exchanger according to claim 2, wherein the distributors are evenly distributed around the axis of symmetry of the shell, and wherein an intermediate space is provided between two adjacent distributors in each case.

4. The wound heat exchanger according to claim 2, further comprising a plurality of connecting channels, wherein a connecting channel is associated with each distributor.

5. The wound heat exchanger according to claim 1, wherein the connecting channel runs parallel to the axis of symmetry.

6. The wound heat exchanger according to claim 1, wherein the first annular channel and the second annular channel protrude radially towards the axis of symmetry of the shell to different extents into the shell.

7. The wound heat exchanger according to claim 6, wherein the second annular channel protrudes radially towards the axis of symmetry of the shell further into the shell than the first annular channel.

8. The wound heat exchanger according to claim 1, wherein the first annular channel is arranged above the second annular channel when viewed along a direction of gravity.

9. The wound heat exchanger according to claim 1, further comprising a tube sheet which is in fluid connection with tubes of the bundle of tubes, and wherein the tube sheet is arranged between the first annular channel and the second annular channel when viewed along the axis of symmetry.

10. The wound heat exchanger according to claim 1, wherein the first annular channel and/or the second annular channel each run completely around the axis of symmetry of the shell.

11. The wound heat exchanger according to claim 1, wherein the first annular channel and/or the second annular channel are each open in the direction of a cover portion of the shell.

12. A method for the exchange of heat between a refrigerant and a medium with the aid of a wound heat exchanger, which comprises a shell having an inner surface, a bundle of tubes which is arranged inside the shell, a first annular channel which is arranged inside the shell and runs around the inner surface of the shell, a second annular channel which is arranged inside the shell and runs around the inner surface of the shell, and a connecting channel which establishes a fluid connection between the first annular channel and the second annular channel, wherein the first annular channel and the second annular channel are spaced apart from one another along an axis of symmetry of the shell, the method comprising the following steps:

a) flowing the medium through the bundle of tubes, b) separating a liquid phase of the refrigerant from a gaseous phase of the refrigerant with the aid of the first annular channel, c) conducting the liquid phase into the second annular channel with the aid of the connecting channel, and d) evenly distributing the liquid phase over the bundle of tubes with the aid of the second annular channel to exchange heat between the refrigerant and the medium.

13. The method according to claim 12, wherein, in step d), the liquid phase is evenly distributed over the bundle of tubes with the aid of a plurality of distributors of the second annular channel.

14. The method according to either claim 12, wherein, in step d), the liquid phase is accumulated in the second annular channel such that the connecting channel opens into the second annular channel below a liquid level of the liquid phase in the second annular channel.

15. The method according to claim 12, wherein, in step b), the liquid phase, when viewed along a direction of gravity, is drawn off downwards from the first annular channel with the aid of the connecting channel, and wherein the gaseous phase emerges upwards from the first annular channel when viewed along the direction of gravity.

16. The wound heat exchanger according to claim 1, wherein the first annular channel is subdivided into a plurality of separate ring segments.

17. The wound heat exchanger according to claim 1, wherein the second annular channel is subdivided into a plurality of separate ring segments.

18. The wound heat exchanger according to claim 1, wherein the second annular channel has an inside diameter that is smaller than an inside diameter of the first annular channel.

19. The wound heat exchanger according to claim 1, wherein the bundle of tubes is wound onto a core tube, and the core tube is positioned along the axis of symmetry of the shell.

20. A wound heat exchanger for the exchange of heat between a refrigerant and a medium, comprising:

a shell, a bundle of tubes which is arranged inside the shell and through which the medium can flow, a first annular channel which is arranged inside the shell and runs around the shell and is intended for separating a liquid phase of the refrigerant from a gaseous phase of the refrigerant, a second annular channel which is arranged inside the shell and runs around the shell and is intended for evenly distributing the liquid phase over the bundle of tubes in order to exchange the heat between the refrigerant and the medium, and a connecting channel which establishes a fluid connection between the first annular channel and the second annular channel in order to conduct the liquid phase out of the first annular channel into the second annular channel, wherein the first annular channel and the second annular channel are spaced apart from one another along an axis of symmetry of the shell, and wherein the first annular channel and the second annular channel protrude radially towards the axis of symmetry of the shell to different extents into the shell, and the second annular channel protrudes radially towards the axis of symmetry of the shell further into the shell than the first annular channel.

* * * * *